US006139638A

United States Patent [19]

Dubois et al.

[11] Patent Number: 6,139,638

[45] Date of Patent: Oct. 31, 2000

[54] FLUID ASSISTED DOCTOR

[75] Inventors: Sylvain Dubois, Lac Beauport; Claude Mallette, Vaudruil, both of Canada

[73] Assignee: Thermo Web Systems, Inc., Auburn, Mass.

[21] Appl. No.: 09/229,433

[22] Filed: Jan. 13, 1999

Related U.S. Application Data

[60] Provisional application No. 60/072,708, Jan. 27, 1998.

[51] Int. Cl.[7] ..... B05C 1/04

[52] U.S. Cl. ..... 118/413; 118/126; 118/261; 118/410; 162/281; 15/256.5; 15/256.51

[58] Field of Search ..... 118/126, 261, 118/410, 413; 162/281; 15/256.5, 256.51; 101/157, 169; 427/365

[56] References Cited

U.S. PATENT DOCUMENTS

| | | | |
|---|---|---|---|
| 2,940,418 | 6/1960 | Penrod et al. . | |
| 5,066,364 | 11/1991 | Goodnow et al. | 162/281 |
| 5,161,838 | 11/1992 | Ely et al. . | |
| 5,932,010 | 8/1999 | Madrzak et al. | 118/413 |

FOREIGN PATENT DOCUMENTS

| | | | |
|---|---|---|---|
| 0485597A1 | 5/1992 | European Pat. Off. . | |
| 1199122 | 8/1965 | Germany . | |
| 3941242 | 6/1991 | Germany . | |
| 4108167 | 9/1992 | Germany . | |
| 4303315 | 6/1993 | Germany . | |
| 19548303 | 6/1997 | Germany . | |
| 1222732 | 4/1986 | U.S.S.R. | 162/281 |

*Primary Examiner*—Laura Edwards
*Attorney, Agent, or Firm*—Samuels, Gauthier & Stevens

[57] ABSTRACT

A holder is disclosed for applying the working edge of a doctor blade to a moving surface. The holder has upper and lower holder members constructed and arranged respectively to contact upper and lower surfaces of the doctor blade, with the doctor blade projecting forwardly to terminate at its working edge. One of the holder members comprises a composite of sandwiched elements enclosing one or more chambers having forwardly directed outlets. A pressurized fluid is introduced into the chambers for forward application via the outlets and along a surface of said doctor blade onto the surface being doctored.

6 Claims, 3 Drawing Sheets

FLUID ASSISTED DOCTOR

CROSS REFERENCE TO RELATED APPLICATIONS

This application claims priority from provisional application Ser. No. 60/072,708 filed Jan. 27, 1998 and entitled Air Doctor Blade DST Holder.

BACKGROUND OF THE INVENTION

1. Field of the Invention

This invention relates generally to doctor systems used to scrape the rotating rolls of papermachines, coaters, and web converting machines and the like for cleaning or dewatering purposes, and is concerned in particular with the provision of a fluid assisted doctor for such doctoring systems.

2. Description of the Prior Art

The three main components of a doctor system include a rigid doctor structure or beam, a doctor blade holder, and a doctor blade. The doctor system is adapted to be mounted in a papermachine, coater or web converting machine and is used to scrape the rotating rolls for cleaning or dewatering purposes. At some critical roll positions in a papermachine, the doctor system is also used during the threading process to remove or "shed" either a full width sheet of paper or a narrower "tail".

In conventional doctoring, the working edge of the doctor blade is loaded against the surface of the rotating roll to provide the scraping or cleaning action. The loading force must be sufficient to hold the blade firmly against the roll surface.

In some cases, the rolls have grooves machined into their surfaces. This makes sheet shedding or cleaning of the roll surfaces with a single doctor difficult, if not impossible. Attempts to address this problem include increasing blade loading forces, which produces other attendant drawbacks, including increased frictional wear of the roll surfaces and doctor blades.

SUMMARY OF THE INVENTION

The object of the present invention is to avoid or at least significantly minimize the above-mentioned problems by providing a fluid assisted doctor. In a preferred embodiment of the invention to be described hereinafter in greater detail, the fluid is a thin jet of air directed along a surface of the doctor blade to impinge on the roll surface directly adjacent to the point of application of the doctor blade's working edge. This results in more efficient sheet shedding and/or cleaning of the roll surface, at lower blade loading levels. The air jet will penetrate into and efficiently clean debris from roll grooves, in addition to reducing the buildup of debris under the doctor blade.

BRIEF DESCRIPTION OF THE DRAWINGS

These and other objects, features and advantages of the present invention will now be described in greater detail with reference to the accompanying drawings, wherein.

DETAILED DESCRIPTION OF PREFERRED EMBODIMENT

Figure 1:
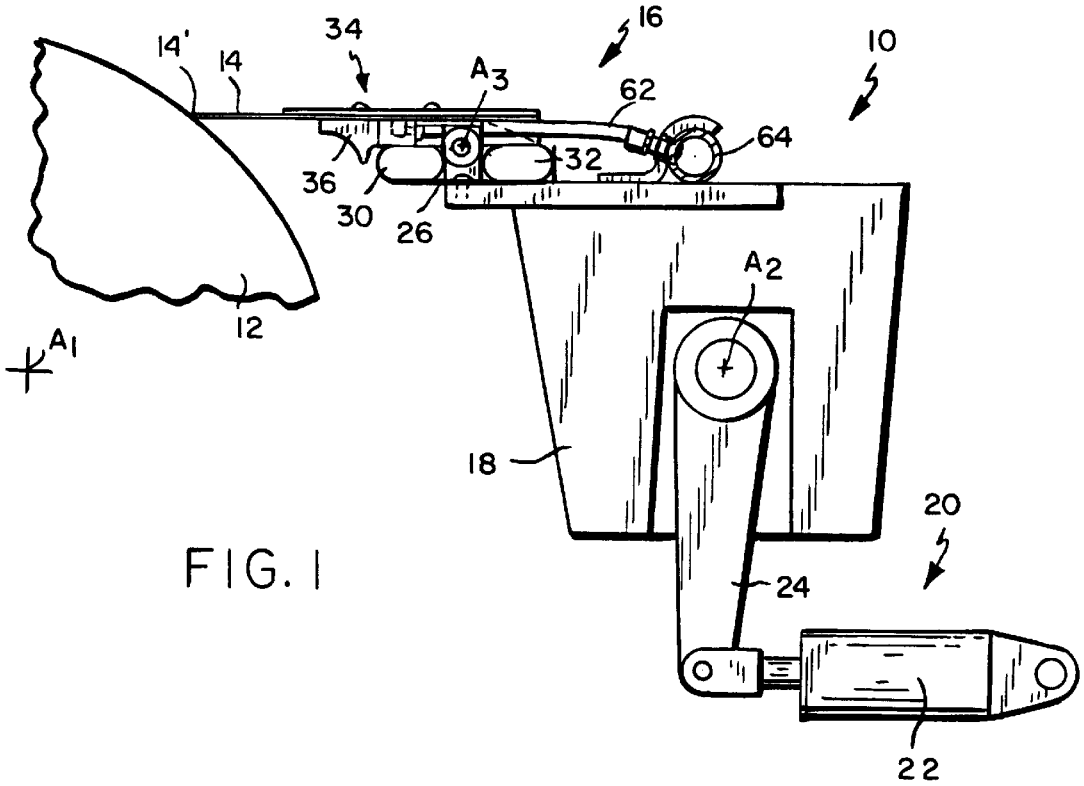
FIG. 1 is a side view of a doctoring system incorporating a fluid assisted doctor blade holder in accordance with the present invention.

With reference initially to FIG. 1, a doctoring system is generally depicted at 10 adjacent to a papermachine roll 12. Roll 12 is driven by conventional means (not shown) for rotation about an axis $A_1$ extending in the cross-machine direction. The doctoring system includes a doctor blade 14, a blade holder 16, a doctor back 18, and a loading mechanism 20. The doctor back is mounted on the papermachine frame (not shown) for pivotal movement about an axis $A_2$ extending in the cross-machine direction parallel to the rotational axis $A_1$ of roll 12. The loading mechanism 20 includes a piston-cylinder unit 22 acting through lever arm 24 to pivot the doctor back 18 about its axis $A_2$ in order to load the working edge $\mathbf{14}_N$ of the doctor blade 14 against the surface of the roll 12.

Figure 3:
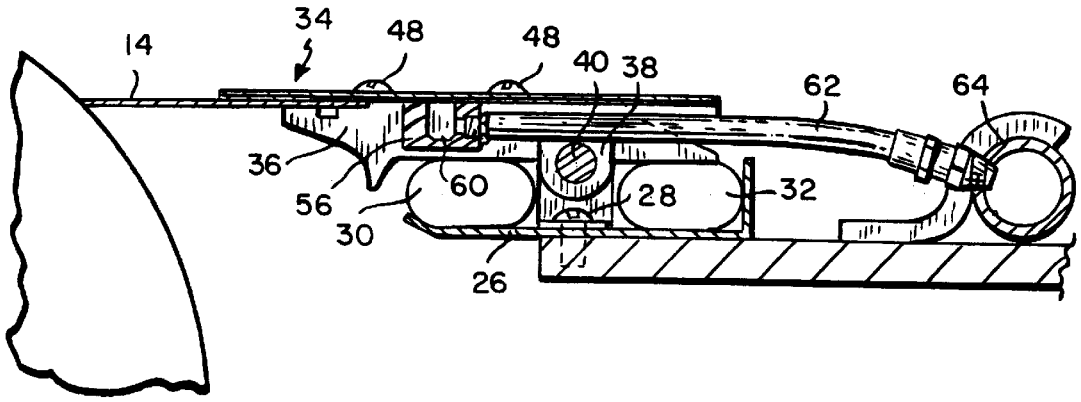
FIG. 3 is a sectional view taken along line 3—3 of FIG. 2.
Figure 2:
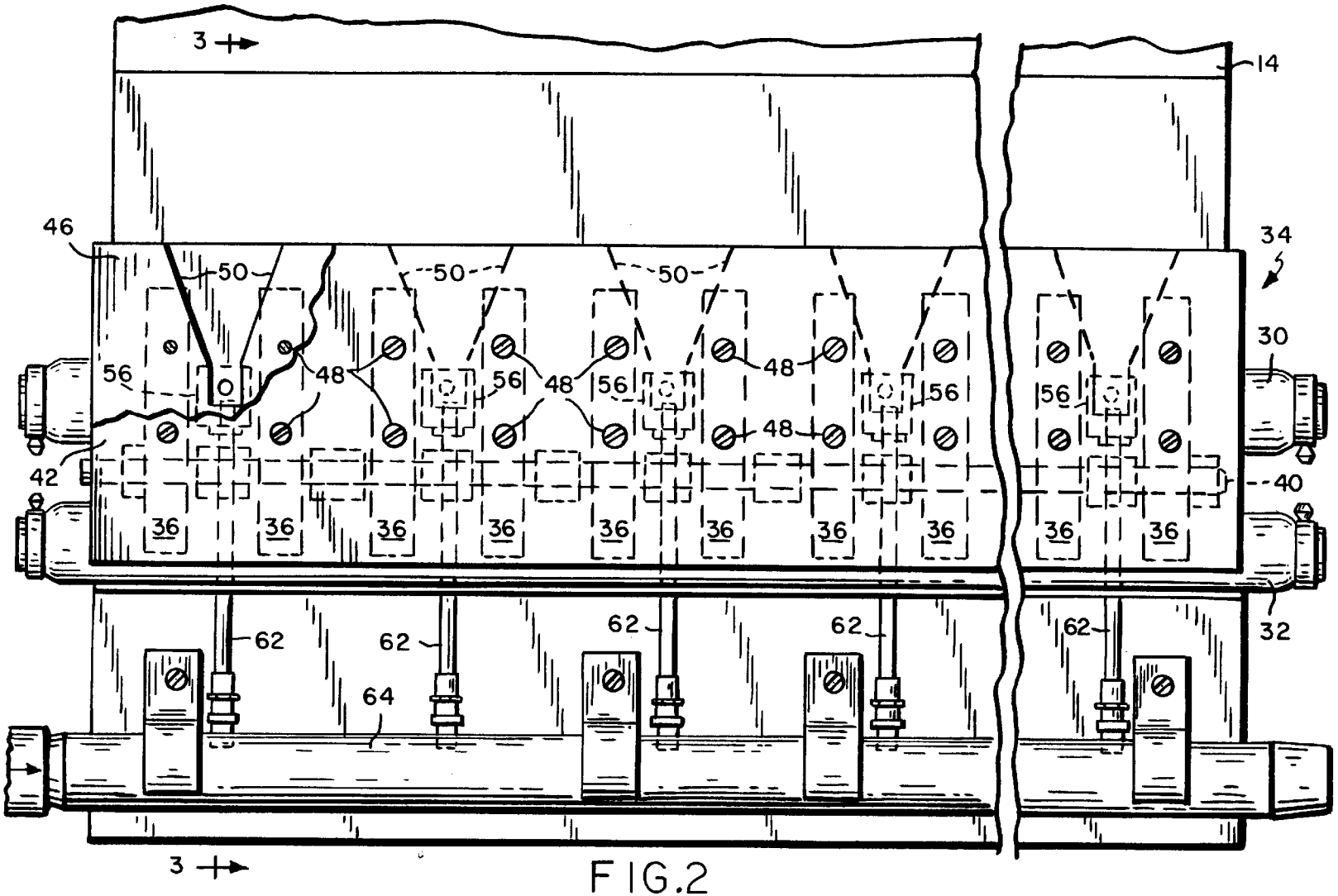
FIG. 2 is a top plan view, on an enlarged scale, of the fluid assisted doctor blade holder depicted in FIG. 1.
Figure 4:
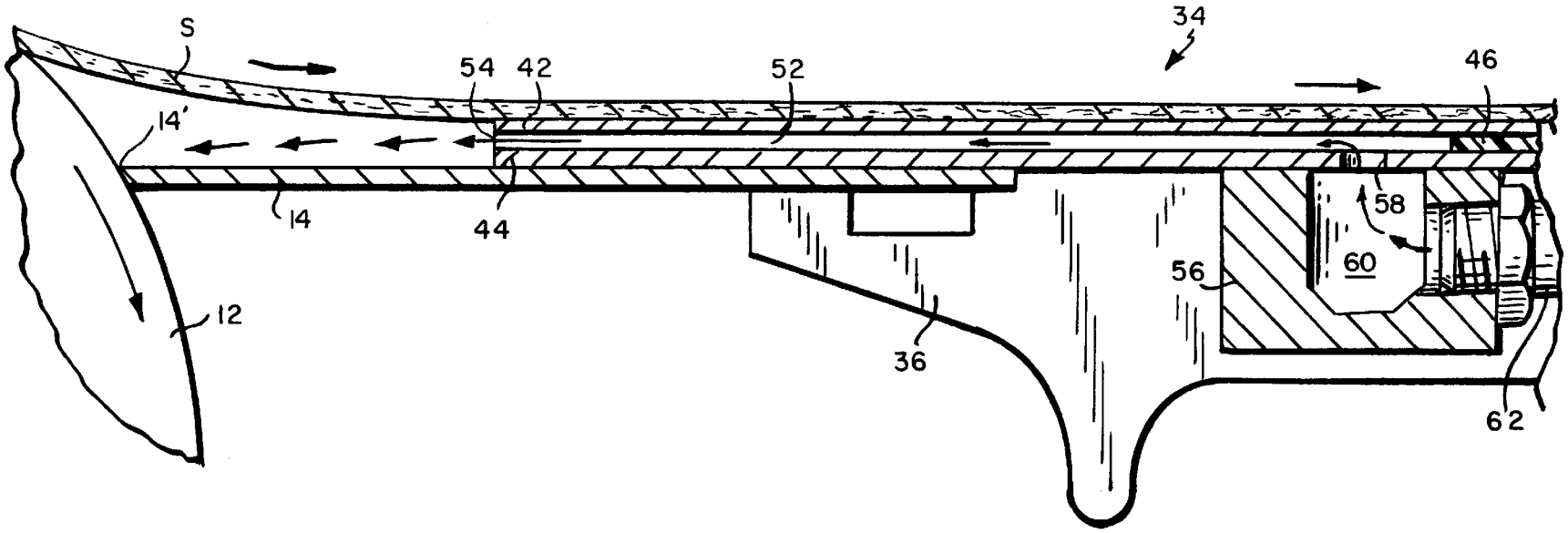
FIG. 4 is an enlarged sectional view of a portion of the doctor blade holder depicted in FIG. 3.

With reference additionally to FIGS. 2–4, it will be seen that the blade holder 16 includes a tray 26 with upstanding brackets 28 located between an unloading tube 30 and a loading tube 32. The doctor blade is removably received between and held by a planar upper holding member generally depicted at 34 and lower holding members comprising laterally spaced fingers 36. The fingers 36 overlie and extend transversally across the tubes 30, 32, and are provided with depending flanges 38 which are connected to the upstanding brackets 28 of the tray 26 by a rod 40, thereby accommodating independent pivotal movement of the fingers about a third axis $A_3$ parallel to axes $A_1$ and $A_2$.

The upper blade holding member 34 comprises a composite of sandwiched planar elements which, as can best be seen in FIG. 4, includes a top plate 42, a bottom plate 44 and a gasket 46 interposed therebetween. The composite is held together by screws indicated typically at 48 which also serve to secure the composite to the underlying fingers 36.

The gasket 46 is notched as at 50, or otherwise appropriately configured, to provide as shown in FIG. 4, one or more chambers 52 communicating with forwardly directed slot-shaped outlets 54.

Connecting blocks 56 are secured to the underside of the bottom plate 44 beneath the chambers 52. The bottom plate has inlets 58 connected by angled passages 60 in the connecting blocks 56 to branch conduits 62, which in turn are connected to a header 64 extending along the rear of the upper holding member 34. The header is supplied with fluid under pressure. Typically, the fluid will be air supplied at a pressure of about 2 to 40 psig., but other fluids including water may also be employed.

During the doctoring process, while the working edge $\mathbf{14}_N$ of the doctor blade is applied against the roll surface, pressurized fluid will flow from the header 64 via the branch conduits 60 and through the connecting passageways 60 and chambers 52 to exit the slot-shaped outlets 54 as thin jets which continue across and in parallel relationship with the upper surface of the doctor blade to impinge upon the roll surface directly adjacent to the point at which the working edge $\mathbf{14}_N$ of the doctor blade is being applied.

The impinging air jets assist in removing debris from the roll surface, and in preventing accumulation of debris on and around the doctor blade. In addition, where the doctor blade is being employed to shed a paper web from the roll surface, as shown in FIG. 4, the impinging air jets assist and indeed may be primarily responsible for lifting the sheet "S" from the roll surface. If the roll surface is grooved, the impinging fluid jets will penetrate into and dislodge debris from the grooves, thereby providing an efficient cleaning action without having to increase blade loading.

The slot-like outlets are configured to achieve optimum application of the pressurized fluid to the roll surface. Typically, when operating with air as the working fluid, the gasket 46 will be sized to produce a gap between the top and bottom plates 42, 44 at the outlets 54 of about 0.005 to 0.125 inches. The exiting flow of air will be substantially laminar, and directed along the top surface of the doctor blade.

In light of the foregoing, it will now be appreciated by those skilled in the art that various modifications may be made to the embodiment herein chosen for purposes of disclosure without departing from the spirit and scope of the invention as defined by the claims appended hereto. For example, the composite planar upper blade holder and associated fluid supply components may be incorporated into blade holder designs other than those having unloading and loading tubes 30, 32. The working fluid can be air, water or any other conveniently available liquid or gas. Fluid application can be continuous or intermittent. The fluid outlets 54 can be arrayed over the entire length of the doctor blade, or only along selected segments thereof. Instead of being notched to provide mutually spaced outlets 54, the gasket 46 can be configured to provide one continuous slot extending in parallel relationship to the working edge $\mathbf{14}_N$ of the doctor blade.

We claim:

1. A holder for applying the working edge of a doctor blade to a moving surface, said holder comprising: upper and lower holder members constructed and arranged respectively to contact upper and lower surfaces of said doctor blade, with said doctor blade projecting forwardly beyond said holder members to terminate at said working edge, one of said holder members comprising a composite of sandwiched elements including top and bottom plates separated by a gasket, said gasket being configured to coact with said plates in defining a plurality of chambers communicating with forwardly directed outlets, and fluid supply means for introducing a pressurized fluid into said chambers for forward application via said outlets along a surface of said doctor blade onto said moving surface.

2. The blade holder of claim 1 wherein said fluid is air.

3. The blade holder of claim 1 wherein said fluid is water.

4. The blade holder of claim 1 wherein said outlets define a plurality of discrete nozzles.

5. The blade holder of claim 1 wherein said outlets are arranged to direct said fluid along the upper surface of said doctor blade.

6. The blade holder of claim 1 wherein said fluid supply means comprises a fluid header located rearwardly of and extending in parallel relationship to said upper holder member, with branch connections leading from said fluid header to inlets communicating with said chambers and spaced along one of said sandwiched elements.

* * * * *